US005203037A

United States Patent [19]

Kang

[11] Patent Number: 5,203,037

[45] Date of Patent: Apr. 20, 1993

[54] WASHING DEVICE FOR A HUMAN BODY

[75] Inventor: Se-Hee Kang, Seoul, Rep. of Korea

[73] Assignee: Samsung Electronics Co., Ltd., Suweon, Rep. of Korea

[21] Appl. No.: 805,951

[22] Filed: Dec. 12, 1991

[30] Foreign Application Priority Data

Dec. 14, 1990 [KR] Rep. of Korea ..... 90-20668

[51] Int. Cl.[5] ..... A47K 3/20

[52] U.S. Cl. ..... 4/420.4; 4/448

[58] Field of Search ..... 4/420.1, 420.2, 420.4, 4/420.5, 447, 448

[56] References Cited

U.S. PATENT DOCUMENTS 4,304,016 12/1981 Oguma et al. ..... 4/420.2
4,628,548 12/1986 Kurosawa et al. ..... 4/420.1 X
4,807,311 2/1989 Ingels ..... 4/448 X
4,829,606 5/1989 Hirashiba et al. ..... 4/420.4
5,025,511 6/1991 Takeda et al. ..... 4/447

*Primary Examiner*—Charles E. Phillips
*Attorney, Agent, or Firm*—Burns, Doane, Swecker & Mathis

[57] ABSTRACT

A bidet comprises a frame adapted to be mounted to a toilet bowl. The frame includes a water chamber. A nozzle pipe is slidably connected to the frame so as to be slidable between first and second operating positions. The frame carries a motor-driven valve actuator, and the nozzle pipe carries two valves, one of which is aligned with the valve actuator when the nozzle pipe is in either of its operating positions. By actuating a first motor an operator positions an outlet of the nozzle pipe in either of two positions, and by operating a second motor the operator causes water to be ejected through the outlet.

7 Claims, 3 Drawing Sheets

WASHING DEVICE FOR A HUMAN BODY

BACKGROUND OF THE INVENTION

1. Field of the Invention

This invention relates to a washing device for a human body, and more particularly to a bidet-type of washing device which is mounted to a toilet bowl.

2. Prior Arts

In most versions of such a washing device for a human body, commonly referred to as a bidet, a nozzle pipe having a plurality of injection holes at one end is slidably installed within a main body of the washing device where the nozzle pipe moves forward or backward within a predetermined stroke. Since the injecting position of the device, i.e., the position of the device when there occurs an ejection of cleaning water through the injection holes, is prescribed, it has disadvantages that the injecting position of cleaning water cannot be varied upon whether the user is male or female as well as whether the body part which needs cleaning is an anal area or a genital area, thereby restricting the cleaning efficiency. Further, when the nozzle pipe moves forward by means of the pressure of the supplied cleaning water, some cleaning water is uselessly injected through the nozzle holes where the clothes of the user become wet and increases the cleaning water consumption.

To solve the above mentioned disadvantages, Japanese Patent Laid-Open Publication No. 60-242236 discloses a washing device having a slide valve mounted on a guide pin, where the slide valve cuts off the injection of cleaning water during the forward movement of a nozzle pipe so as to decrease the cleaning water consumption. However the slide valve may become coated with scale that is concentrated with organic materials dissolved in cleaning water according to the operation over a long period. Accordingly, as the opening or closing function of the water passage by the slide valve deteriorates, the saving of cleaning water is remarkably reduced. Also the device has a defect in that it cannot change the water-injecting position of the nozzle pipe.

In order to slove the above defects, there is disclosed a washing device as Japanese Patent Laid-Open Publication No. 62-170624. This invention comprises a first and a second washing body of identical construction, having a respective nozzle pipe therein which is resiliently mounted with a spring and has a different stroke for changing the water-injecting position, and a switching valve including a stationary disc and a pivotable disc where the latter can be pivoted relative to the former in order to selectively open or close an inlet or outlet to supply the first or the second washing body with pressurized warm water. Upon the selective pivot motion of the pivotable disc with respect to the stationary disc the pressurized water flows into the first or the second washing body, thereby the nozzle pipe installed within the first or the second washing body overcomes the resilient force of the spring and moves forward to inject pressurized warm water for cleaning operation.

Meanwhile, the device as mentioned above has a complicated construction involving two separate washing bodies. Moreover, in case that the spring destined to restore the nozzle pipe to its initial position becomes rusted due to the moisture, the first or the second washing body cannot be operated in a proper manner. Therefore it has disadvantages that the longevity and the fidelity of the washing operation is lowered.

There is also disclosed a prior art in which a nozzle pipe moves forward or backward by a driving mechanism including a pinion and a rack so as to change the injecting position of cleaning water. But such art has defects that the operational components are easily broken down and the cleaning water consumption is still large.

SUMMARY OF THE INVENTION

Therefore, the present invention has been made to solve the above mentioned problems.

It is an object of the present invention to provide a washing device for a human body which is capable of controlling an injecting flow rate and injecting strength of cleaning water as well as changing an injecting position of cleaning water at two locations in accordance with physical conditions of user or body portion to be cleansed.

To achieve the above object, the washing device in accordance with the present invention comprises a frame having a hollow interior and a first motor through a bracket thereon; a cylindrical water chamber mounted in front of said frame for reserving cleaning water introduced through a cleaning water inlet; a nozzle pipe formed with a plurality of nozzle holes at one end and watertightly installed within said water chamber, said nozzle pipe moving forward or backward therein; a first and a second valve member spaced apart in a predetermined distance on the upper surface of said water chamber; an operating member for controlling the opening degree of said first or second valve member to provide said nozzle pipe with cleaning water retained within said water chamber; and a nozzle pipe drive member for slidably positioning said nozzle pipe at a first or a second location spaced apart within said water chamber.

According to the washing device of this invention, the operating member controls the opening degree of the first or the second valve member so that the injecting flow rate and injecting strength of cleaning water through the nozzle pipe can be adjusted. Moreover, since the driving member causes to move the nozzle pipe to the first or second location, the injecting position of cleaning water through the nozzle pipe can be changed.

These and other objects and features of the invention will be more fully appreciated from the following detailed description when taken in conjunction with the accompanying drawings in which;

BRIEF DESCRIPTION OF THE DRAWINGS

FIG. 3 (*b*) is similar to FIG. 3(*a*) illustrating the operation of the valve member when the washing operation is performed;

DETAILED DESCRIPTION OF THE PREFERRED EMBODIMENT

Figure 1:
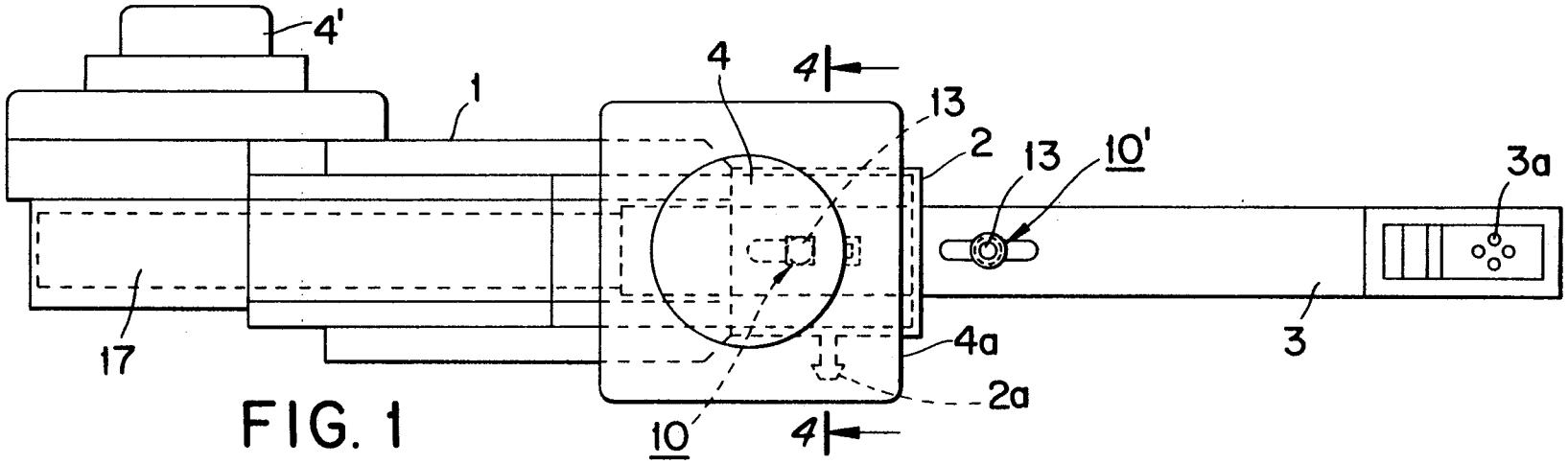
FIG. 1 is a plan view illustrating the washing device in accordance the present invention.

Now, a preferred embodiment of the washing device of the present invention will be described in detail with reference to the accompanying drawings.

Referring FIGS. 1 to 4 reference numeral 1 denotes a frame supporting various components of a washing device. A cylindrical water chamber 2 provided with a cleaning water inlet 2*a* is installed at the frontal end of the frame 1. A nozzle pipe 3 formed with a plurality of nozzle holes 3*a* at one end is co-axially installed within the water chamber 2 in a watertight manner where the nozzle pipe 3 can move slidably in horizontal plane with respect to the water chamber 2. A first motor 4 is mounted on an upper surface 2*b* of the water chamber 2 through bracket 4*a* in which the first motor 4 is apt to revolve in normal (forward) direction or reverse direction according to a control signal transmitted from a controller (not shown). An operating member 5 is installed at the upper surface 2*b* of the water chamber 2. The operating member 5 is provided with a guide member 7 and a pusher in the form of a screwing rod 6 which operates a valve member, described hereinafter, with the driving force delivered from the first motor 4. The screwing rod 6, which is formed with a male screw portion 6*a* on its outer periphery has its lower end 6*b* is configured in a rod shape, is engaged with a female screw portion 7*a* formed on the interior surface of a hole formed in the guide member 7. The screwing rod 6 revolves to move upward or downward relative to the guide member 7 upon the rotation of the first motor 4 in normal direction or reverse direction, respectively.

Here, a connecting rod 8 is secured to the interior portion of the screwing rod 6 and its upper end is connected with a shaft 4*b* of the first motor 4 through a coupling, thereby the connecting rod 8 can transmit the driving force of the first motor 4 to the screwing rod 6. The connecting rod 8 is formed with a protruding bar 8*a* which is extended horizontally from the middle portion thereof. The protruding bar 8*a* is designed to restrict the movement range of the screwing rod 6 with combined operation of a stopper 9 protruded on the upper surface 2*b* of the water chamber 2.

Meantime, a pair of first and second valve members 10 and 10' are installed spaced apart on the nozzle pipe 3 adjacent the water chamber 2. Since the constructions of the first and the second valve members 10 and 10' are identical, now for the purpose of easy description, only the construction of the first valve member 10 will be described by way of an example.

That is, the first valve member 10 is provided with a cylindrical receiving basin 11 having a plurality of through holes 11*a* on the outer periphery thereof. A ball 13 shaped in a hemisphere is resiliently installed within the receiving basin 11 by means of a spring 12. The upper peripheral edge of the receiving basin 1 is formed with a bent portion 11*b* which plays the role of a valve seat securely contacting with the outer surface of the ball 13 due to the spring force.

Upon the opening operation of the ball 13 away from the bent portion 11*b* of the receiving basin 11 due to the downward movement of the screwing rod 6, cleaning water filled within the water chamber 2 can be introduced into the interior of the nozzle pipe 3. Also, the inflow rate, i.e., the injecting amount and the injecting strength of cleaning water can be controlled in accordance with the opening degree of the clearance between the ball 13 and the bent portion 11*b* of the receiving basin 11.

At the rear end of the frame 1, there is provided a nozzle pipe drive member 14 moving the nozzle pipe 3 forward or backward in a predetermined range where the extension length of the nozzle pipe 3 with respect to the frame 1 can be changed. The nozzle pipe drive member 14 is provided with a cylindrical drum 15 which is connected with a second motor 4'. A steel strip 17 is wound around the drum 15 where one end of the strip 17 is secured to the drum 15 through a pin 16 and an opposite end of the strip 17 is secured to a disc 18 attached at the rear end of the nozzle pipe 3.

When the second motor 4' revolves in a normal (forward) direction or in a reverse direction by a control signal transmitted from a controller (not shown), the drum 15 revolves clockwise or counterclockwise to wind-off or wind-up the strip 17 on its circumferential periphery. Therefore, the nozzle pipe 3 secured to the strip 17 moves through the water chamber 2 between two predetermined orientations, whereby the extension length of the nozzle pipe 3 can be varied to change the water injecting position of the holes 3*a*.

Next, the operation of the washing device in accordance with the present invention will be described hereinafter.

Figure 2:
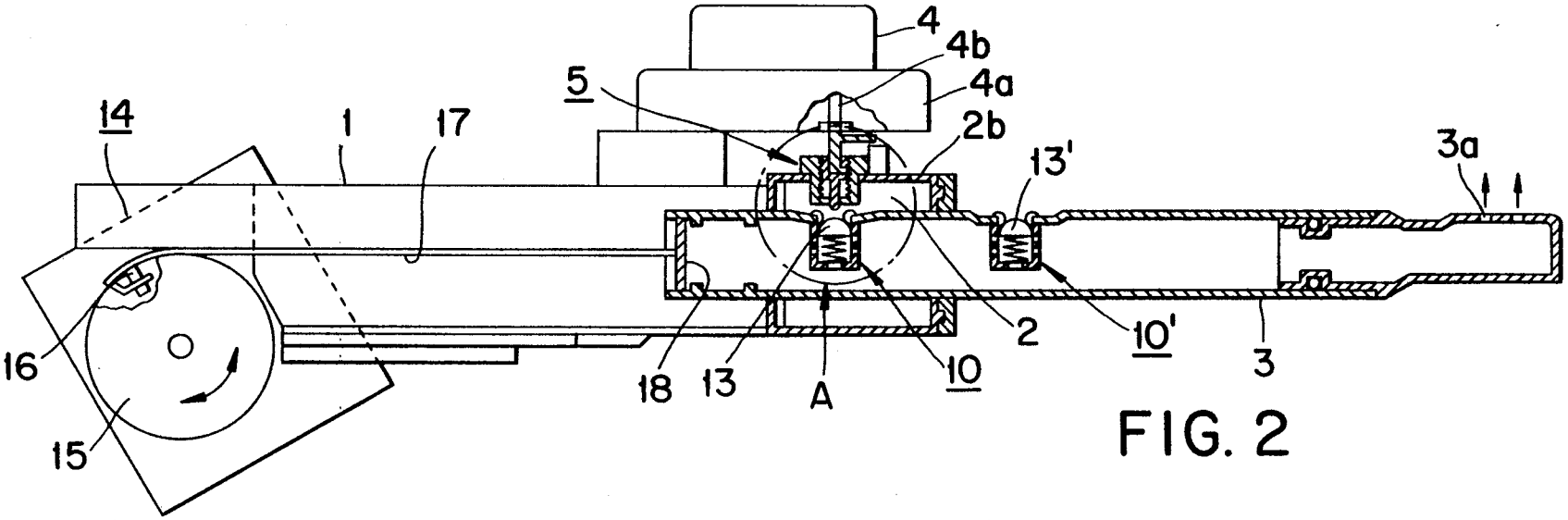
FIG. 2 is a partially broken front sectional view of FIG. 1.

In FIGS. 1 and 2, there is disclosed the washing device of this invention where the nozzle pipe 3 is maintained at a first location, i.e., an injecting position for cleaning a genital area of the adult, while no cleaning operation is performed.

In case that the user operates a cleaning function button (not shown) of the controller (not shown) in order to clean the genital area, a control signal is transmitted to the first motor 4 and drive it. Therefore the first motor 4 revolves in a normal direction to rotate the screwing rod 6 through the connecting rod 8 coupled to the motor shaft 4*b*, whereby the screwing rod 6 moves downward within the guide member 7.

Here, as the user continues to operate the cleaning function button, the screwing rod 6 continues to be moved downward so as to depress the upper surface of the ball 13 installed at the receiving basin 11. Hence, the ball 13 tightly contacted with the bent portion 11*b* becomes depressed to make a clearance therebetween, thereby cleaning water retained within the water chamber 2 is introduced into the receiving basin 11 through the clearance. Then the cleaning water passes through the through holes 11*a* and flows along the interior of the nozzle pipe 3 to be injected through the holes 3*a* for cleaning operation.

In such case, the user can control the injecting flow rate or the injecting strength of cleaning water injected through the holes 3*a*; that is, as the user manipulates the cleaning function button (not shown) for controlling the movement of the screwing rod 6 against the ball 13, the clearance between the bent portion 11*b* of the receiving basin 11 and the outer periphery of the ball 13 can be varied, thereby the flow rate of cleaning water from the water chamber 2 to the nozzle pipe 3 through the clearance can be controlled.

Figure 3A:
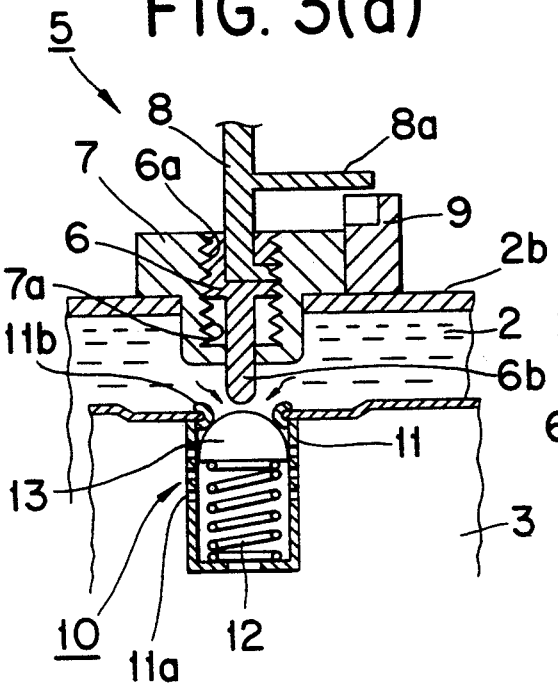
FIG. 3 (*a*) is an enlarged sectional view illustrating the circled "A" portion of FIG. 2.
Figure 3B:
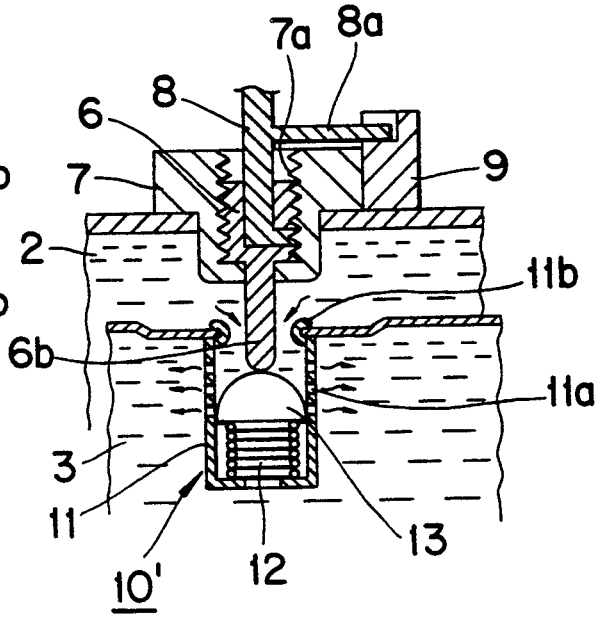
Figure 4:
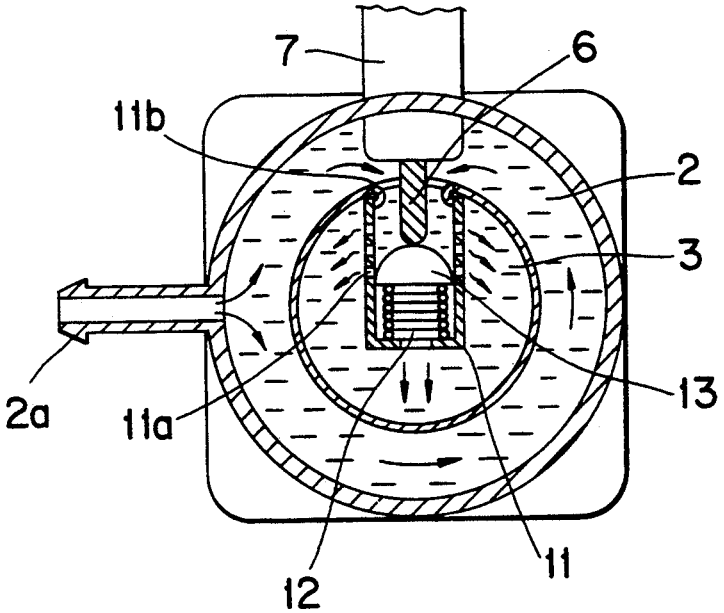
FIG. 4 is an enlarged sectional view of the essential part along the line 4—4 of FIG. 1 when the washing operation is performed.

For instance, if the user intends to inject cleaning water at maximum flow rate, he should continue to depress the cleaning function button until the protruding bar 8*a* of the connecting rod 8 is blocked by the stopper 9 as shown in FIG. 3(*b*). In such case, the descending stroke of the screwing rod 6 relative to the guide member 7 becomes maximum value, which means the clearance between the bent portion 11*b* of the receiving basin 11 and the ball 3 becomes also maximum value. Therefore cleaning water injected through the holes 3*a* has maximum flow rate and maximum strength thereof.

Next, the operation of changing the injecting position of the washing device in accordance with the physical condition of the user or the area to be cleansed will be described as below.

When the user intends to clean his anal area, the injecting position of cleaning water should be moved to a predetermined location (referred to as a second location) nearer toward the frame 1 than as shown in FIG. 2. To this end, as the user manipulates the cleaning position button (not shown), a control signal is transmitted from the controller (not shown) to the second motor 4' so as to rotate it in a reverse direction.

The drum 15 connected to the second motor 4' also revolves counterclockwise, whereby the strip 17 whose one end is secured to the disc 18 of the nozzle pipe 3 is wound up around the drum 15. Of course, the second motor 4' is designed to rotate in a predetermined revolution to move the nozzle pipe 3 to the second location where the second valve member 10' provided at the nozzle pipe 3 comes to be located under the screwing rod 6 of the operating member 5 as shown in FIG. 5.

In this state, as the user manipulates the cleaning function button (not shown), cleaning water is injected through the holes 3*a* by the cooperative motion between the screwing rod 6 and the ball 13 of the second valve member 10' as described above.

Figure 5:
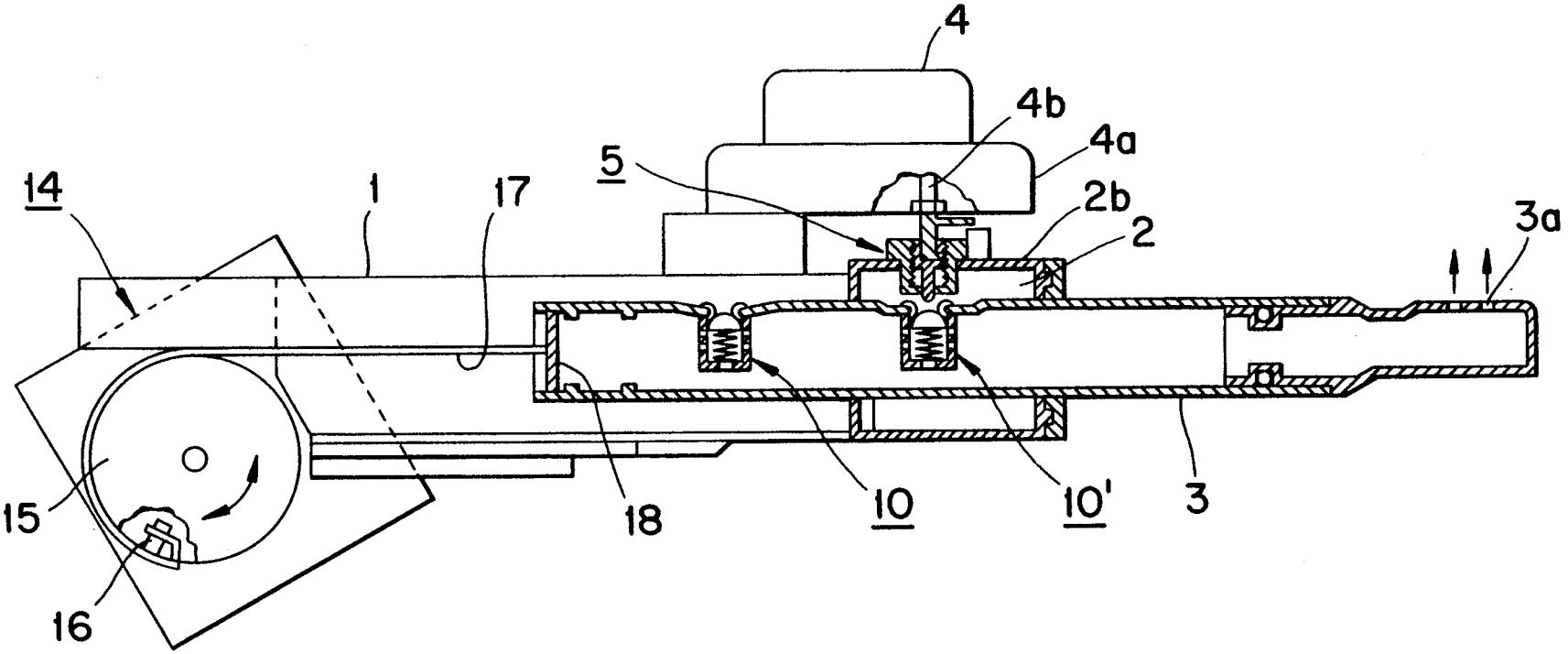
FIG. 5 is similar to FIG. 2 illustrating the state the injecting position is changed.

Meanwhile, when the user intends to change the injecting position of clean water from the second location as shown in FIG. 5 to the first location as shown in FIG. 2, the user has to manipulate the cleaning position button (not shown) in order to rotate the second motor 4' in a normal direction. Therefore the strip 17 becomes unwound from the drum 15 and moves the nozzle pipe 3 forward to be extended from the frame 1 as shown in FIG. 2. At this state, the injecting operation of clean water can be performed as described above upon the manipulation of the cleaning function button (not shown) by the user.

Meantime, after the cleaning operation of the anal or the genital area is finished, the user manipulates the cleaning function button (not shown) in order to stop injecting action of the washing device. That is, upon the reverse manipulation of the cleaning function button (not shown), the first motor 4 revolves in a reverse direction to move the screwing rod 6 upward within the guide member 7, whereby the depressing force applied by the lower end 6*a* of the screwing rod 6 toward the ball 13 is released. Accordingly, the ball 13 moves upward by the restoring force of the spring 12 so that the outer periphery of the ball 13 may contact with the bent portion 11*b* of the receiving basin 11. As a result, there remains no clearance between the ball 13 and the bent portion 11*b*, and cleaning water cannot pass through the clearance. Therefore, the injecting operation of cleaning water through the holes 3*a* of the nozzle pipe 3 is no longer performed.

As described above the washing device in accordance with the present invention can change the injecting position of clean water by the nozzle pipe drive member 14 between the first location and the second location corresponding to the physical condition of the user. Moreover, the injecting strength of cleaning water through the holes 3*a* can be adjusted by the cooperation of the valve member 10 and 10' with the operating member 5 to control the opening degree of the clearance between the ball 13 and the bent portion 11*b* of the receiving basin 11. Therefore the present invention has the effects that it is convenient to use and easy to manufacture with simple construction.

The foregoing disclosure and description of the invention is illustrative and explanatory thereof, and various changes in the size, shape and materials, as well as in the details of the illustrated construction, may be made within the scope of the appended claims without departing from the spirit of the invention.

What is claimed is:

1. A bidet-type washing device for attachment to a toilet bowl for washing an anal area or genital area of a human body, comprising:

a frame for attachment to said toilet bowl, said frame having a motor-driven valve actuator;

a nozzle pipe mounted in said frame for movement between first and second positions corresponding to anal and genital positions, respectively, said nozzle pipe having a water outlet including a plurality of nozzle openings;

power-driven displacing means for displacing said nozzle pipe between said first and second positions;

first and second valve means mounted on said nozzle pipe and arranged to be selectively positioned for actuation by said actuator, when said nozzle pipe is in said first and second positions, respectively; and water-supplying means for supplying pressurized water to said valve actuator so that when either of said first and second valve means is opened by said actuator, water is ejected through said first or said second valve means and then through said nozzle openings.

2. A washing device according to claim 1, wherein said water-supplying means comprises a water chamber carried by said frame such that said first and second valve means communicate with said water chamber when said nozzle pipe is in said first and second positions, respectively.

3. A washing device according to claim 1, wherein each of said first and second valve means comprises a valve seat and a valve element spring-biased against said seat, said valve actuator comprising pusher means for pushing said valve element away from said valve seat by a selected distance.

4. A washing device according to claim 3, wherein each of said first and second valve means comprises an apertured cylinder in which said valve element is displaceably mounted.

5. A washing device according to claim 3, wherein said valve actuator comprises a threaded guide, said pusher means being threadedly mounted to said threaded guide such that rotation of said pusher means about an axis causes said pusher means to be axially advanced toward a selected one of said valve elements, and motor means for rotating said pusher means about said axis.

6. A washing device according to claim 5, wherein a stop member is attached to said pusher means for limiting the axial advancement of said pusher means.

7. A washing device according to claim 1, wherein said power-driven displacing means comprises a drum mounted on said frame, a strip having one end wound on said drum and another end attached to said nozzle pipe, and a motor for rotating said drum whereby rotation of said drum is transmitted to said nozzle pipe to displace the latter.

* * * * *